US005301517A

United States Patent [19]

Bustos

[11] Patent Number: 5,301,517

[45] Date of Patent: Apr. 12, 1994

[54] REFRIGERATED SHELF MERCHANDISER

[75] Inventor: Rafael Bustos, Alpharetta, Ga.

[73] Assignee: L&P Property Management Company, Chicago, Ill.

[21] Appl. No.: 93,309

[22] Filed: Jul. 16, 1993

Related U.S. Application Data

[63] Continuation of Ser. No. 891,653, May 29, 1992, abandoned.

[51] Int. Cl.[5] ..... A47F 3/04

[52] U.S. Cl. ..... 62/251; 62/255; 62/252; 312/116

[58] Field of Search ..... 62/246, 251, 252, 255, 62/256, 457.9; 312/116, 236

[56] References Cited

U.S. PATENT DOCUMENTS

| | | | |
|---|---|---|---|
| 1,959,926 | 5/1934 | Reich | 211/127 |
| 2,271,103 | 7/1941 | Sherman | 62/255 |
| 2,271,802 | 2/1942 | Nordskog | 62/246 |
| 2,305,319 | 12/1942 | Pirnie | 312/116 X |
| 2,499,088 | 2/1950 | Brill et al. | 62/89.5 |
| 2,528,916 | 11/1950 | Shreve | 62/89.5 |
| 2,836,039 | 5/1958 | Weber | 62/251 |
| 2,973,631 | 3/1961 | Adkins | 62/246 |
| 3,010,290 | 11/1961 | Frederick | 62/251 |
| 3,203,197 | 8/1965 | Zaslovsky et al. | 62/277 |
| 3,263,745 | 8/1966 | Henry | 165/48 |
| 3,675,440 | 7/1972 | Ibrahim | 62/256 |
| 4,250,955 | 2/1981 | Plattner et al. | 165/14 |
| 4,319,463 | 3/1982 | Ljung | 62/256 |
| 4,373,355 | 2/1983 | Monroe | 62/256 |
| 4,628,697 | 12/1986 | Bruck et al. | 62/255 X |
| 5,201,191 | 4/1993 | Bustos | 62/249 |

*Primary Examiner*—William E. Tapolcai
*Attorney, Agent, or Firm*—Wood, Herron & Evans

[57] ABSTRACT

A merchandiser for merchandising refrigerated food products comprised as a support structure having two ends, refrigerated merchandising shelves spanning between the ends of the support structure, and a refrigerator for refrigerating product located on the refrigerated merchandising shelves. Each shelf is individually supplied with refrigerated air from the refrigerator. The merchandiser is placed adjacent checkout aisle with one end of the merchandiser abutting an end of the checkout counter, and preferably the express lane checkout counter. Refrigerated food products are thereby accessible and removable from the refrigerated merchandising shelves of the merchandiser from either side of the merchandiser as customers pass down the aisles to the express lane checkout stations.

10 Claims, 4 Drawing Sheets

REFRIGERATED SHELF MERCHANDISER

This application is a continuation of application Ser. No. 07/891,653 filed May 29, 1992, now abandoned.

FIELD OF THE INVENTION

This invention relates to merchandising, and more particularly to point of purchase displays for simultaneously merchandising refrigerated and non-refrigerated consumer food products.

BACKGROUND OF THE INVENTION

Merchandising displays, and more particularly, point of purchase displays, are well known for retailing products. Such merchandising displays or racks are also well known for use adjacent checkout counters of grocery stores, supermarkets and the like for the display and merchandising of beverages, snack items and the like. The items displayed thereon are usually of the variety which requires no refrigeration.

Another newer type of merchandising display now also in use adjacent checkout counters includes means for refrigerating the products displayed therein. Such refrigerated displays or so-called showcases have taken many forms, some of which include chest-type open refrigerators, and upright refrigerators or cooling cases having a series of shelves therein and either an open front or a glass-covered front for displaying products therein. Such showcases are useful for displaying, for example, beverages, dairy products, and various types of frozen foods.

Another type of merchandising display employed in supermarkets and the like is the so-called "salad bar island". Such a display is typically employed to display refrigerated salad items from which a customer can pick and choose as desired. The items are selected from the salad bar island and are placed into a container which is weighed at the checkout station of the supermarket and priced accordingly.

Still another type of display employed in the larger supermarkets is a deli-type display. Such a display is generally employed in conjunction with the deli department of a large supermarket wherein various deli meat items, cheeses, salads and other prepared foods are chilled and displayed for retail sale. The various items are selected by the customer, are weighed by the deli attendant, and are paid for at the checkout aisle of the supermarket.

A criticism of the numerous aforementioned displays, and particularly the salad bar island-type display and deli-type display, is that a customer must make a specific trip to these displays which are generally located in specific peripheral areas of the supermarket. Specifically, a customer wishing to pick up a salad or a deli item from the salad bar island or the deli, respectively, in conjunction with his normal shopping list of items, cannot just simply retrieve those desired shopping list items and handily and quickly pick up that desired salad or deli item as he walks to the checkout aisle. The customer must make a specific detour to the peripheral area within the large supermarket to obtain these additional items.

Studies have indicated that a very large percentage of the traffic through the larger supermarkets is through the so-called "express" lanes. Such express lanes are utilized for customers having a small quantity of items, for example, 8–12, and generally cash is required for the purchases. Such express lanes facilitate quick shopping trips for those customers who have only a few items to purchase. Normally such customers forego side trips to the supermarket's deli and salad bar as requiring too much time.

It has therefore been one objective of the present invention to eliminate the need for a supermarket customer to make a specific detour or trip within the supermarket to select salad bar items or deli items in conjunction with the more traditional supermarket items purchased.

It has been another objective of the present invention to provide the capability of merchandising chilled or refrigerated items such as salad bar type and deli type items to such an express lane customer, which customer is purchasing a small quantity of items and is utilizing the express lane checkout of the supermarket in order to facilitate a more speedy shopping trip.

SUMMARY OF THE INVENTION

In accordance with the stated objectives, the present invention is a food merchandiser for merchandising refrigerated food products. The merchandiser comprises a support structure having two ends, refrigerated merchandising shelves spanning between the ends of the support structure, and a refrigerator for refrigerating product located on the refrigerated merchandising shelves. Each refrigerated merchandising shelf is individually supplied with refrigerated air from the refrigerator. The merchandiser is placed adjacent a checkout aisle with one end of the merchandiser abutting an end of the checkout counter, and preferably the express lane checkout counter. Refrigerated food products are thereby accessible and removable from the refrigerated merchandising shelves of the merchandiser from either side of the merchandiser as customers pass down the aisles to the express lane checkout stations. Such a merchandiser is particularly adapted for the merchandising display of salad bar-type items and deli-type items. The merchandiser of the present invention can draw upon the refrigerator of a separate beverage merchandiser placed adjacent to the food merchandiser for the refrigerated air for the refrigerated merchandising shelves. Or, preferably the food merchandiser can have the refrigeration unit contained within the food merchandiser itself as a component thereof. Further, each refrigerated merchandising shelf can employ its own dedicated refrigeration unit.

Another embodiment of the present invention includes unrefrigerated merchandising shelves spanning between the ends of the support structure in addition to the refrigerated merchandising shelves. The food merchandiser of this embodiment thereby makes provision for merchandising of refrigerated and unrefrigerated food products which can be accessed and removed from the refrigerated and unrefrigerated merchandising shelves respectively from either side of the merchandiser as customers pass down the checkout aisles toward the express lane checkout stations.

Another aspect of the present invention is predicated upon a self-contained food merchandising shelf for merchandising refrigerated food products. The self-contained food merchandising shelf is adapted to be supported on a support structure and comprises a product supporting shelf structure, a transparent cover for displaying and providing access to food products on the shelf structure, and a refrigeration unit within the self-contained food merchandising shelf for refrigerating products located on the shelf structure. The self-contained food merchandising shelf can be placed on an existing support structure placed adjacent a check-out aisle to allow refrigerated food products, and specifically deli and salad bar items, to be accessed and removed therefrom. This aspect of the invention allows existing express lane merchandising support structures to be readily retrofitted with a refrigerated food merchandising shelf.

One advantage of the present invention is that the merchandising of various food items within a supermarket is facilitated, and specifically the point of purchase merchandising of salad bar-type and deli-type food items is facilitated.

Another advantage of the present invention is that deli-type and salad bar-type food items are merchandised for display and sale to so-called "express lane" customers, which normally would forego a side trip to the peripheral locations or areas within a supermarket required to access these items.

Yet another advantage of the present invention is that existing express lane merchandising support structures may be readily retrofitted with the capability to merchandise deli and salad bar-type food items which require refrigeration.

These and other objects and advantages of the present invention will become more readily apparent during the following detailed description taken in conjunction with the drawings herein, in which:

DESCRIPTION OF PREFERRED EMBODIMENTS

Figure 1:
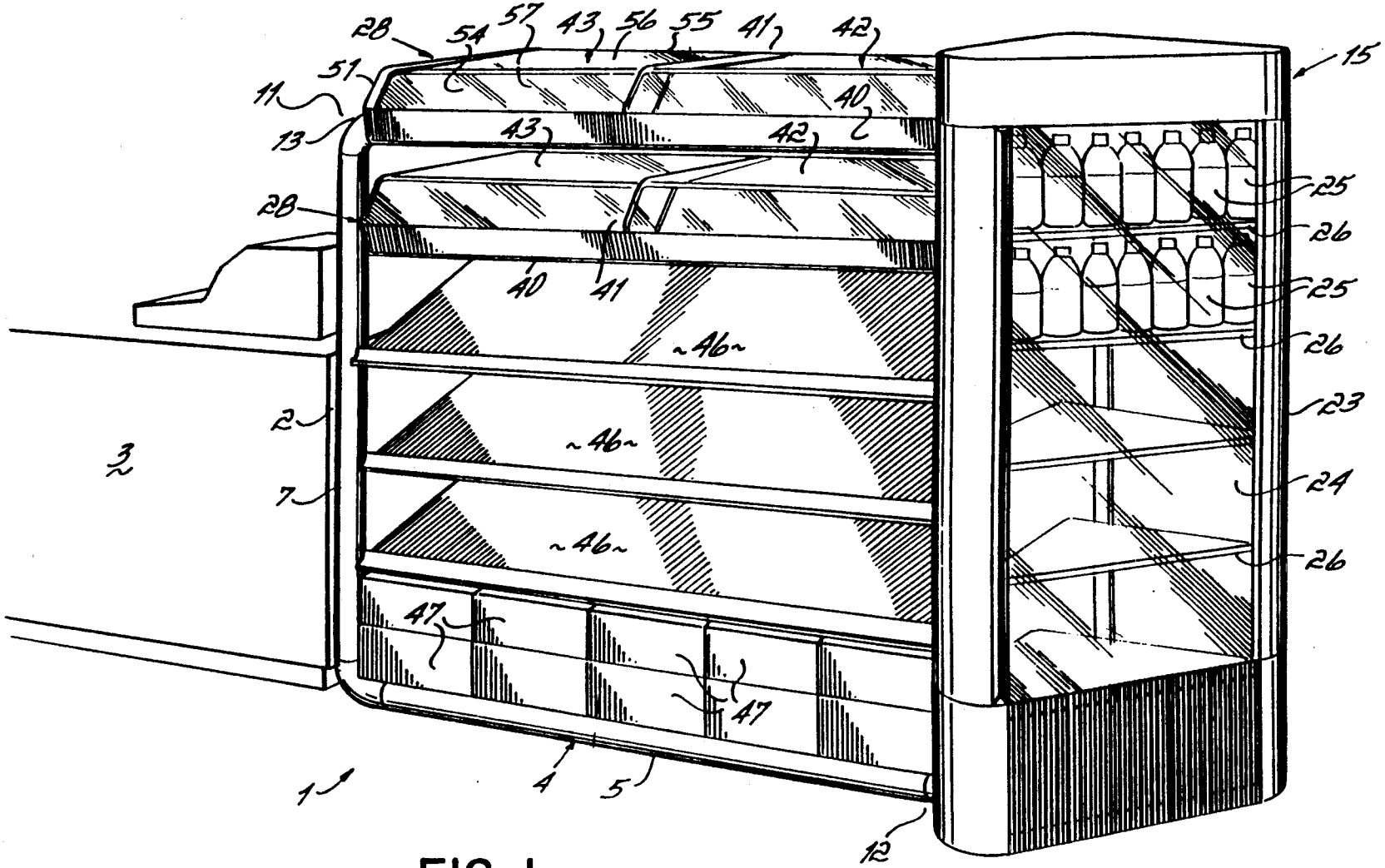
FIG. 1 is a perspective view of one embodiment of the food merchandiser of the present invention.

With reference first to FIG. 1, there is illustrated one embodiment of a food merchandiser 1 of the present invention. The food merchandiser 1 is preferably located adjacent the so-called "express lane" in a supermarket, and preferably is positioned abutting the end 2 of the checkout counter 3 of such an "express lane".

Describing now this merchandiser 1, it employs a support structure 4 which could take many forms, but which is illustrated as a series of tubular sections, including two floor-contacting base sections 5 and 6, a pair of upwardly extending shelf-supporting sections 7, 8 and 9, 10 at either end 11 and 12 of the merchandiser 1, and a horizontal supporting section 13 and 14 at either end 11, 12 of the merchandiser 1 connecting the vertical supporting sections 7, 8 and 9, 10 respectively.

Figure 2:
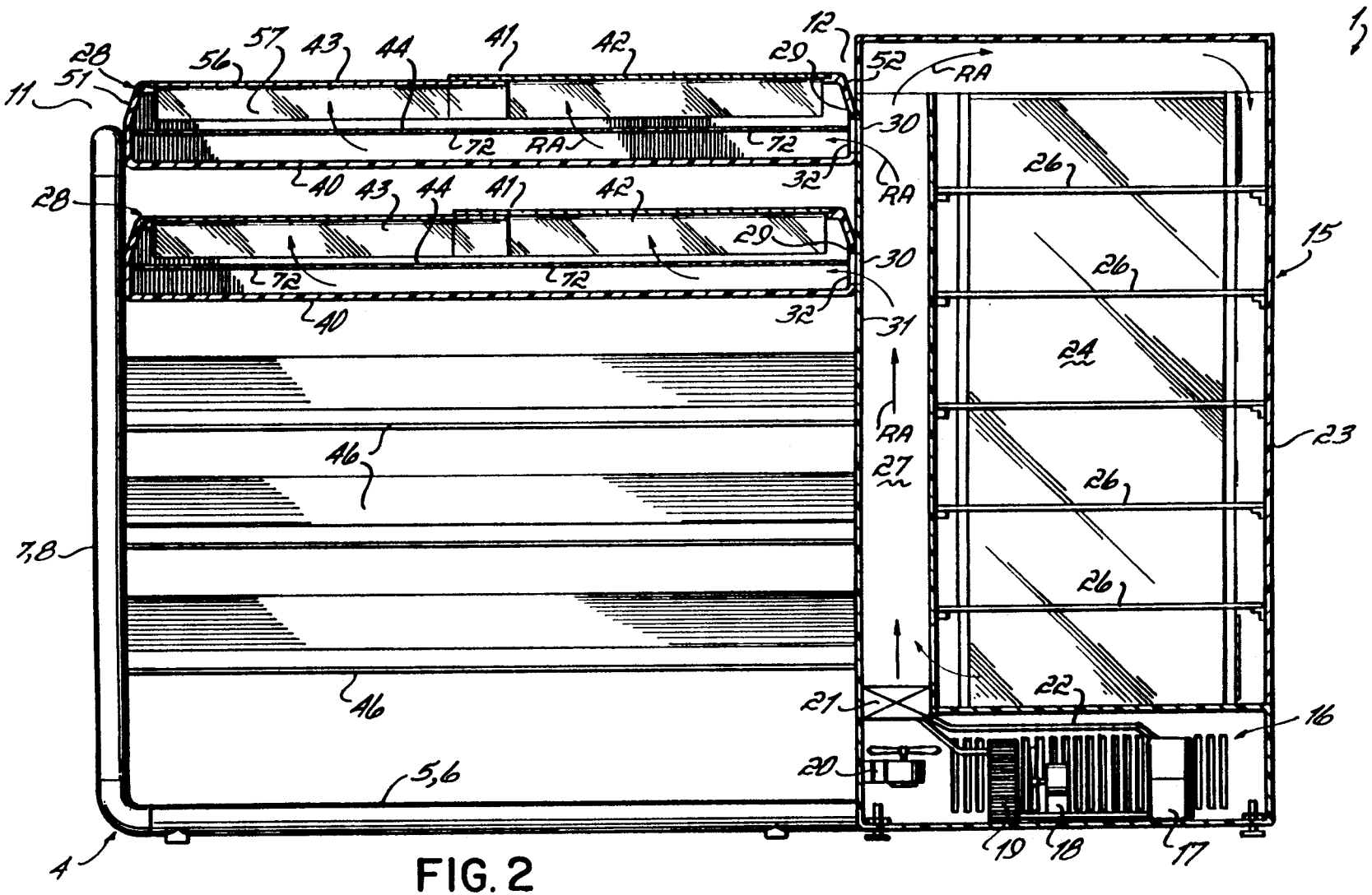
FIG. 2 is a side elevational view, in section, of the merchandiser of FIG. 1.

Referring specifically to the embodiment illustrated in FIGS. 1 and 2, the merchandiser 1 is illustrated being used in conjunction with a refrigerated beverage display merchandiser 15. The merchandiser 15 includes a conventional refrigeration unit 16 including a compressor 17, fan 18, condenser 19, fan 20, evaporator 21 and refrigerant loop 22. The beverage merchandiser 15 includes a cabinet 23 which has pivoting transparent doors 24 for accessing product 25 located on shelves 26 within the cabinet 23. Refrigerated air RA is forced upwardly through a plenum 27 located along the back of the cabinet 23. The refrigerated air RA travels upwardly through the plenum 27 and downwardly over shelves 26 to cool product 25 thereon. A portion of the refrigerated air RA enters the refrigerated merchandising shelves 28 at one end 29 thereof. The plenum 27 of beverage merchandiser 15 communicates with each refrigerated merchandising shelf 28 through holes 30 in the back panel 31 of the beverage merchandiser 15 and holes 32 in the ends 29 of the refrigerated shelves 28. Each refrigerated shelf 28 includes a base 40, end walls 51,52 fixedly attached to and upstanding from the base 40, and a transparent cover or enclosure 41 which includes two slidable portions 42 and 43, thereby allowing access to items located at either end of shelf 28. Each transparent slidable portion 42,43 of the cover 41 comprised a pair of side walls 54,55 and a top wall 56. The slidable portions 42,43 overlap and are each independently longitudinally slidable. Because they are both transparent and slidable, they allow visual and physical access to food products located within the enclosure defined by the end walls 51,52, base 40, and cover 41 of the refrigerated shelves 28. Refrigerated air RA travels through the base 40 of the refrigerated shelves 28 and is forced upwardly through holes (not shown) in a shelf support 44, atop which food products are supported, for cooling same. Alternatively, refrigerated air RA may flow through the base 40 and over the shelf support 44 to cool the shelf support 44 and indirectly the air in the enclosure 57 without flowing over the product contained in the enclosure 57.

Additional unrefrigerated merchandising shelves 46 can be utilized in conjunction with the food merchandiser 1 to simultaneously display refrigerated deli-type or salad bar-type food items requiring refrigeration as well as snack items and the like which require no refrigeration, such as candy, chips, etc. The unrefrigerated shelves 46 are similarly supported by the vertical supports 7,8 and 9,10. Additionally, unrefrigerated bulk containers 47 of beverage, for example soft drinks, can be merchandised in the lowermost location (FIG. 1).

Figure 3:
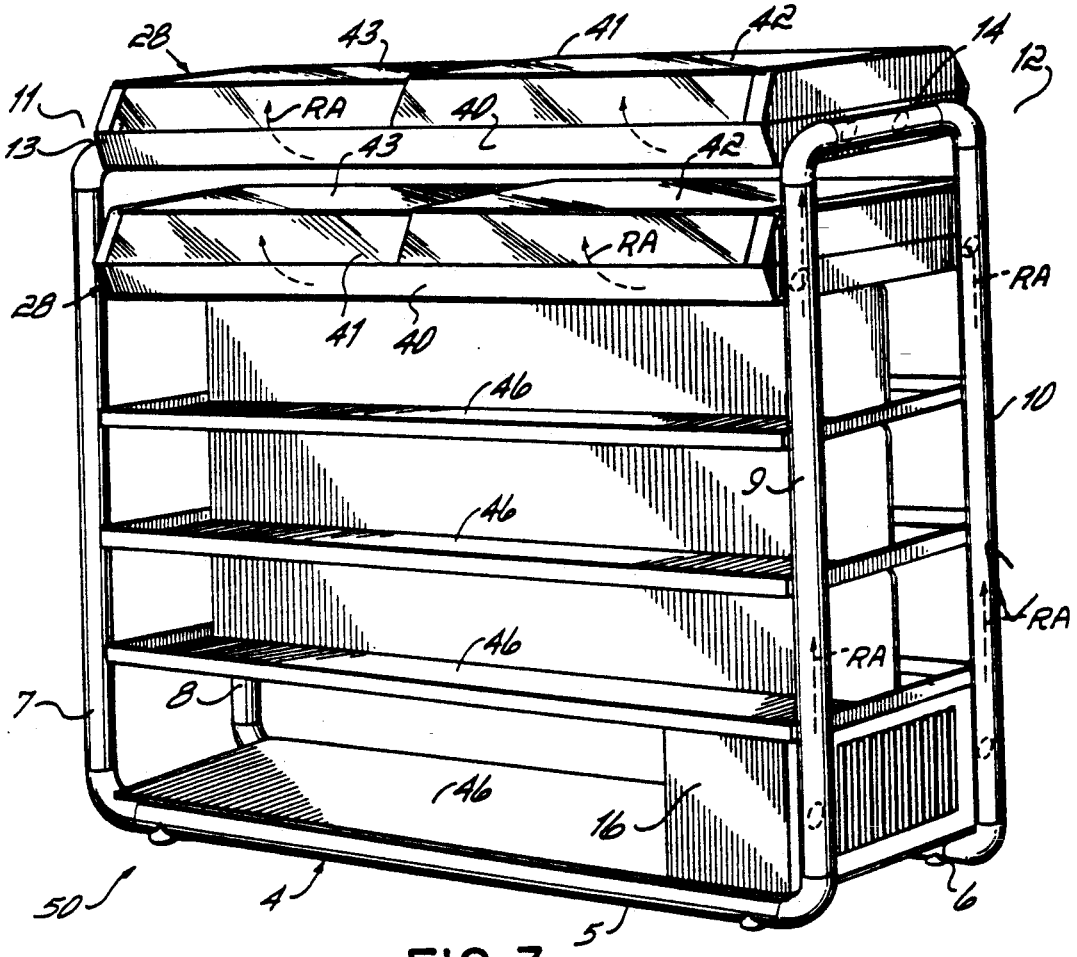
FIG. 3 is a perspective view of another embodiment of the food merchandiser of the present invention.

Referring now to FIG. 3, another embodiment 50 of the present invention is illustrated. With like numbers representing like components, in this embodiment the refrigeration unit 16 is an integral part of the merchandiser 1 and the previous beverage merchandiser 15 described above is not relied upon to provide refrigerated air to the refrigerated shelves 28. The tubular supports 9, 10 and 14 are utilized as conduits to transmit the refrigerated air RA in the refrigeration unit 16 upwardly to and through the refrigerated shelves 28.

Figure 5:
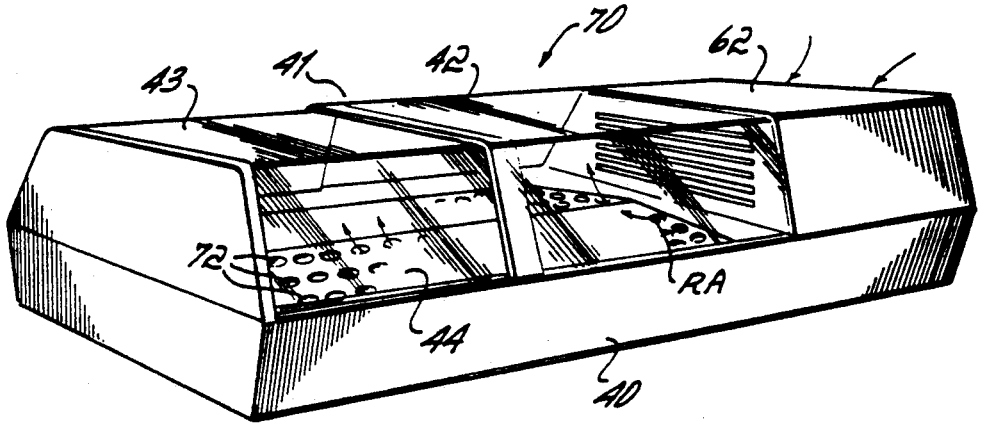
FIG. 5 is a perspective view of the self-contained food merchandising shelf of the present invention.
Figure 4:
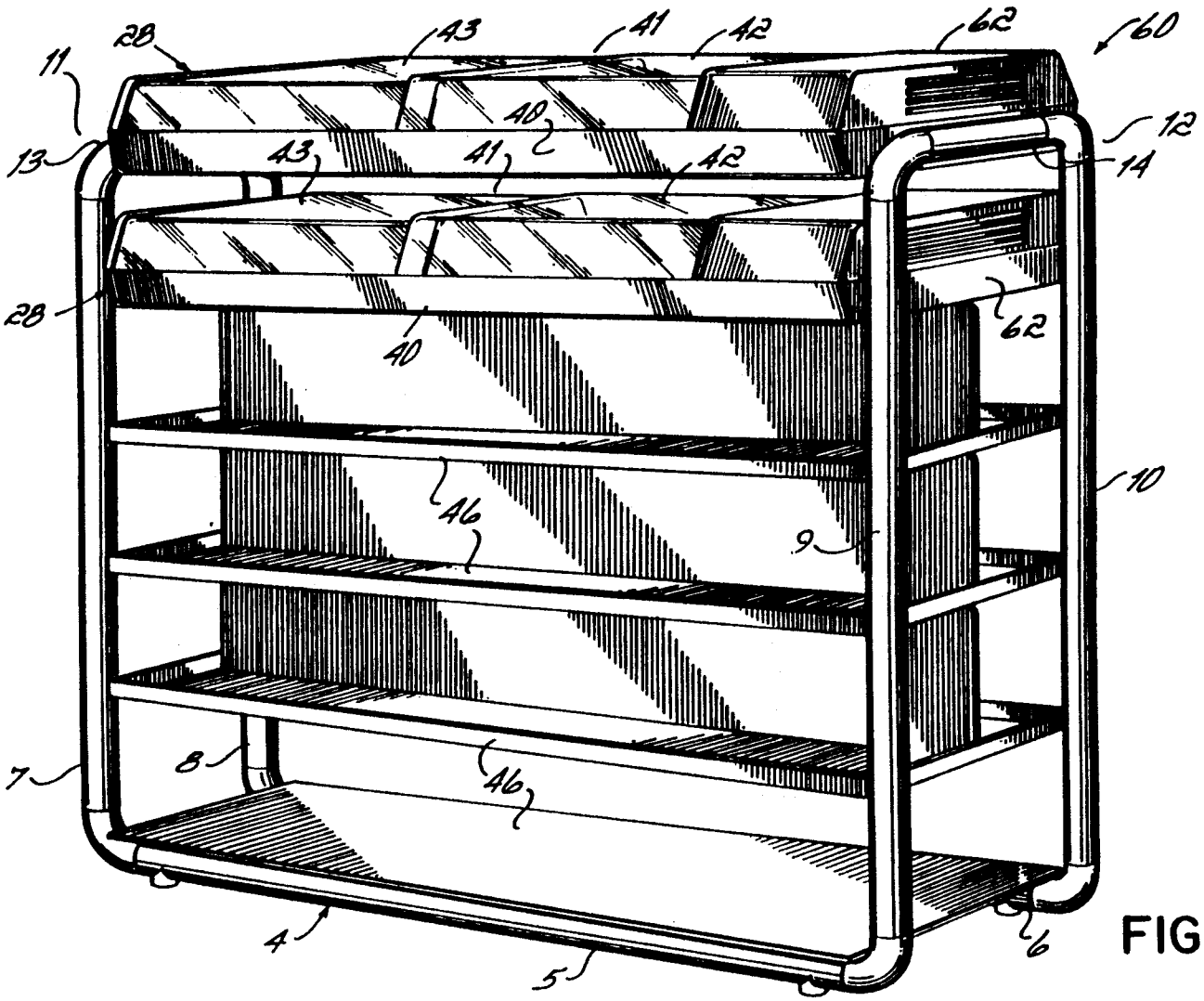
FIG. 4 is a perspective view of yet another embodiment of the food merchandiser of the present invention.

With reference to FIG. 4, there is illustrated yet another embodiment 60 of the present invention. In this embodiment and again with like numbers representing like components, the separate refrigeration unit 16 has been eliminated, and each refrigerated shelf 28 has incorporated on one end thereof a dedicated refrigeration unit 62 as part of the shelf 28. This embodiment lends itself readily to the production of a self-contained food merchandising shelf which would be adapted to be supported on a merchandising support structure. Such a self-contained food merchandising shelf is illustrated at 70 in FIG. 5. Again like numbers representing like components, the shelf 70 is a self-contained unit which includes its own dedicated refrigeration unit 62. The aforementioned transparent cover 41 is employed which utilizes slidable portions 42 and 43 visualizing and accessing product supported on a shelf support 44 within the refrigerated shelf 28. Refrigeration unit 62 supplies refrigerated air through the base 40 of the shelf 28 which travels upwardly through holes 72 in the shelf support 44 for cooling product supported thereby. Such a self-contained unit allows existing express lane merchandising support structures to be readily outfitted with a self-contained refrigerated shelf for merchandising deli items and salad bar items or other refrigerated items at the checkout station of the express lane.

Those skilled in the art will readily recognize numerous adaptations and modifications which can be made to the present invention which will result in an improved food merchandiser, yet all of which will come within the spirit and scope of the present invention as defined in the claims. Accordingly, the invention is to be limited only by the scope of the claims and their equivalents.

What is claimed is:

1. A food merchandiser for merchandising refrigerated food products comprising:

a support structure having two ends;

at least one enclosed refrigerated merchandising shelf for supporting product and for containing refrigerated air spanning between said ends of sad support structure;

means for refrigerating product located on said at least one refrigerated merchandising shelf;

said at least one refrigerated merchandising shelf being individually supplied with refrigerated air from said refrigerating means; and an openable and closable cover means forming at least a part of an enclosure for said at least one merchandising shelf, said cover means permitting access to food products on said shelf when opened, and preventing escape of refrigerated air from said enclosed shelf when closed.

2. The food merchandiser of claim 1 wherein each said refrigerated merchandising shelf includes its own dedicated refrigerating means.

3. The food merchandiser of claim 1 further including at least one unrefrigerated merchandising shelf spanning between said ends of said support structure.

4. A food merchandiser for merchandising refrigerated and unrefrigerated food products comprising:

a support structure having two ends;

at least one enclosed refrigerated merchandising shelf for supporting product and for containing refrigerated air spanning between said ends of said support structure;

means for refrigerating product located on said at least one refrigerated merchandising shelf;

said at least one refrigerated merchandising shelf being individually supplied with refrigerated air from said refrigerating means; and an openable and closable transparent cover means forming at least a portion of an enclosure for said at least one refrigerated merchandising shelf, said transparent cover means enabling product on said at least one refrigerated merchandising shelf to be viewed therethrough and accessed therefrom, said cover means permitting access to food products on said shelf when opened, and preventing escape of refrigerated air from said enclosed shelf when closed.

5. The food merchandiser of claim 4 wherein said transparent cover means extends between and forms a part of each side of each said refrigerated merchandising shelf whereby refrigerated food products can be accessed and removed from said refrigerated merchandising shelves through said transparent cover means from either side of said merchandiser.

6. A food merchandiser for merchandising refrigerated and unrefrigerated food products comprising:

a support structure having two ends;

at least one enclosed refrigerated merchandising shelf for supporting product and for containing refrigerated air spanning between said ends of said support structure;

at least one unrefrigerated merchandising shelf spanning between said ends of said support structure; and means for refrigerating product located on said at least one refrigerated merchandising shelf;

said at least one refrigerated merchandising shelf being individually supplied with refrigerated air from said refrigerating means; and an openable and closable cover means forming at least a part of an enclosure for said at least one merchandising shelf, said cover means permitting access to food products on said shelf when opened, and preventing escape of refrigerated air from said enclosed shelf when closed.

7. The food merchandiser of claim 6 wherein each said refrigerated merchandising shelf includes its own dedicated refrigerating means.

8. The food merchandiser of claim 6 wherein said at least one refrigerated merchandising shelf is located above said at least one unrefrigerated merchandising shelf.

9. A food merchandiser for merchandising refrigerated and unrefrigerated food products comprising:

a support structure having two ends;

at least one enclosed refrigerated merchandising shelf for supporting product and for containing refrigerated air spanning between said ends of said support structure;

at least one unrefrigerated merchandising shelf spanning between said ends of said support structure;

means for refrigerating product located on said at least one refrigerated merchandising shelf;

said at least one refrigerated merchandising shelf being individually supplied with refrigerated air from said refrigerating means; and an openable and closable transparent cover means forming at least a portion of an enclosure on said at least one refrigerated merchandising shelf, said transparent cover means enabling product on said at least one refrigerated merchandising shelf to be viewed therethrough and accessed therefrom, said cover means permitting access to food products on said shelf when opened, and preventing escape of refrigerated air from said enclosed shelf when closed.

10. The food merchandiser of claim 9 wherein said transparent cover means extends between and forms a part of each side of said refrigerated merchandising shelf whereby refrigerated and unrefrigerated food products can be accessed and removed from said refrigerated and unrefrigerated merchandising shelves respectively from either side of said merchandiser.

* * * * *